US006250312B1

(12) United States Patent
Dasilva

(10) Patent No.: US 6,250,312 B1
(45) Date of Patent: Jun. 26, 2001

(54) APPARATUS FOR APPLYING HAIR HIGHLIGHTS

(76) Inventor: Denivaldo G. Dasilva, 200 W. 78th St. Apt. 2D, New York, NY (US) 10024

( * ) Notice: Subject to any disclaimer, the term of this patent is extended or adjusted under 35 U.S.C. 154(b) by 0 days.

(21) Appl. No.: 09/360,323

(22) Filed: Jul. 23, 1999

(51) Int. Cl.[7] ..... A61K 7/13

(52) U.S. Cl. ..... 132/208; 401/289

(58) Field of Search ..... 132/200, 208, 132/216, 217, 218, 221, 112, 129, 132, 144, 145, 146, 148, 313; 401/289, 282, 176

(56) References Cited

U.S. PATENT DOCUMENTS

| | | | | |
|---|---|---|---|---|
| D. 137,637 | | 4/1944 | Nelson et al. . | |
| D. 159,106 | | 6/1950 | Stamp . | |
| D. 183,167 | | 7/1958 | Gore . | |
| D. 268,225 | | 3/1983 | Ellenson . | |
| D. 405,614 | | 2/1999 | Geardino et al. . | |
| 1,546,037 | | 7/1925 | Smart . | |
| 2,004,044 | | 6/1935 | Fiegel . | |
| 2,162,581 | | 6/1939 | Kapelman . | |
| 2,181,448 | | 11/1939 | Behr . | |
| 2,207,427 | | 7/1940 | Behr . | |
| 2,261,755 | | 11/1941 | Downs . | |
| 2,463,611 | | 3/1949 | Green . | |
| 2,602,457 | | 7/1952 | Mele . | |
| 2,705,499 | | 4/1955 | Breeze . | |
| 2,865,383 | * | 12/1958 | Kaley | 132/112 |
| 3,147,757 | | 9/1964 | Hofmann . | |
| 3,349,781 | | 10/1967 | Poole et al. . | |
| 3,800,811 | | 4/1974 | Esposto . | |
| 4,108,184 | | 8/1978 | Morganroth . | |
| 4,196,741 | | 4/1980 | Minghenelli . | |
| 4,552,159 | | 11/1985 | Fabbri et al. . | |
| 4,637,411 | | 1/1987 | Sanders . | |
| 4,672,983 | | 6/1987 | Nath et al. . | |
| 4,747,420 | * | 5/1988 | Alaimo | 132/112 |
| 4,830,030 | | 5/1989 | Busch et al. . | |
| 5,007,442 | * | 4/1991 | Hirzel | 132/218 |
| 5,058,609 | | 10/1991 | Sandoz et al. . | |
| 5,146,937 | | 9/1992 | Lefebvre . | |
| 5,222,268 | * | 6/1993 | Snodgrass | 401/10 |
| 5,307,826 | * | 5/1994 | Iosilevich | 132/218 |
| 5,337,765 | | 8/1994 | Wong . | |
| 5,433,225 | | 7/1995 | Liggett et al. . | |
| 5,533,537 | | 7/1996 | Mourad . | |
| 5,611,361 | * | 3/1997 | Leone | 132/218 |
| 5,706,839 | * | 1/1998 | Patti | 132/208 |
| 5,865,188 | * | 2/1999 | Marquez | 132/132 |
| 6,029,307 | | 2/2000 | Baudoin . | |
| 6,029,675 | * | 2/2000 | Dumler | 132/218 |
| 6,062,231 | | 5/2000 | De Laforcade . | |

FOREIGN PATENT DOCUMENTS

| | | |
|---|---|---|
| 0884008 | 12/1998 | (EP) . |
| 359644 | 11/1931 | (GB) . |

* cited by examiner

*Primary Examiner*—Jeffrey A. Smith
*Assistant Examiner*—Eduardo C. Robert
(74) *Attorney, Agent, or Firm*—Coudert Brothers

(57) ABSTRACT

A novel hair highlighting brush suitable for use in applying color treatment at home or at the hair salon for selected strands of hair separated from a head of hair is provided having a sheet of flexible tubing having at one of the tubing a detachable brush portion that accepts the color treatment and at the other end of the tubing a detachable hair securer so that the selected strands of hairs of different thicknesses can be accepted. The flexible tubing allows both ends to contact so that the selected hairs receive the color treatment while the brush is pulled from the top of the scalp along the length of the selected hairs. Optionally, a pump applicator is affixed atop the removable brush portion so that the color treatment may be applied continuously when the brush is pulled vertically along the selected strands of hair.

88 Claims, 4 Drawing Sheets

APPARATUS FOR APPLYING HAIR HIGHLIGHTS

FIELD OF THE INVENTION

The present invention relates to providing a flexible apparatus for color treating selected strands of hair of different thickness and lengths during home application by utilizing a brush. The present invention also relates to a flexible hair highlighting apparatus that has a pump affixed to one end of the apparatus that continuously applies color treating agents to the hair regardless of the selected hair length.

Overall, the system of the present invention is a breakthrough in the hair highlighting industry in that it is designed for consumer use with ease and precision when applying highlights to selected hair strands at home, and comprises a hand-held device with interchangeable bristle heads or brushes to increase or decrease the thickness of highlights, and an optional solution pump.

BACKGROUND OF THE INVENTION

In recent years it has become increasingly popular to treat hair, and particularly women's hair, by coloring or tinting selected strands of hair while separated and isolated from the remaining hair strands. The processes for carrying out such hair treatment are generally termed "highlighting," "tinting," "streaking," "frosting" or the like.

A number of techniques have been developed for such treatment of hair which provide varying degrees of success depending on the skill of the operator and other such factors. The simplest method of bleaching or coloring hair to achieve a contrasting color is hair painting wherein the operator or beautician simply applies a liquid bleach or dye to selected areas of the head of hair to add the desired highlighting as shown in FIGS. 9A–9F. In this method it is generally desired to color or bleach only the uppermost strands of hair. The liquid dye or bleach, however, tends to reach underlying hair, or may even penetrate the entire depth of the hair, yielding an undesirable result.

Many prior art at-home hair highlighting devices are both cumbersome and awkward to use. Most are dependent of the length and thickness of the selected strands of hair to be color treated, and none provides the kind of ease of use, precision, and consistency provided by the present invention.

As a result, highlighting selected strands of hair has traditionally been a process typically done in professional hair salons. It has been a complicated process usually requiring a skilled stylist's assistance. FIG. 9 shows the multiple steps a stylist takes in order to add highlights to selected sections of hair, carefully avoiding coloring the entire head of hair. This arrangement for achieving a contrasting color is also known as hair painting, where an operator applies liquid bleach or dye to selected areas of the head to add the desired highlighting.

As described in U.S. Pat. No. 3,349,781 (Poole et al.), a stylist parts hair into sections by combing part of the hair over the top of the head, placing a protective sheet over the hair that remains hanging down the back, and pulls strands of hair on to the protective sheet. A brush with a series of spaced tufts is used to brush streaks onto the strands of hair, which lie on the protective sheet. Another protective sheet is placed over those dyed strands, and the process is repeated for every successive layer of highlighting. The dye may potentially reach other hairs, which it is not intended to reach.

A second known procedure for highlighting is placement of a cap, having a number of holes, onto the head, and pulling strands of hair through the holes. The exposed strands are then colored. It may be difficult to ascertain exactly which hairs are being pulled for treatment, and uneven highlighting may result.

A third known arrangement is the wrapping of selected strands in aluminum foil, as described in U.S. Pat. No. 5,433,225 (Liggett). A color blade picks up dye and is moved along the hair, in an attempt to bring strands of hair into contact with the dye. The strands of hair are then wrapped in foil. The foil separates those highlighted strands from the rest of the hair and supports the selected strands of hair to which dye or bleach has been applied. More than one pair of hands may be necessary to keep foils in place. Other devices for wrapping treated pieces of hair include U.S. Pat. Nos. 3,800,811; 4,196,741; 4,552,159; 4,637,411 and 4,672,983.

U.S. Pat. No. 4,830,030 describes an arrangement that uses two rollers made of a sponge material that hold a colorant and dispense it as they move along the hair as they are spring-loaded toward each other. It may be difficult to dispense a precise amount of dye or bleach, and if excess liquid or dye is dispensed, it usually cannot be returned to its original bottle.

U.S. Pat. No. 5,337,765 (Wong) describes a modular brush for applying dye or color with a brush body and detachable bristle modules that may be arranged to achieve a pattern of coloring that the user chooses. The device may not allow for precision in application.

Clamp devices, described by U.S. Pat. No. 4,108,184, are most often comprised of a pair of bars hinged together at one end and having surfaces or attachments at the other end to hold strands of hair and provide a protective shield against the rest of the hair or the scalp, in order to facilitate the application of dye with various other unrelated and structurally different devices.

There is an existing need in the hair highlighting industry for improved devices or apparatus for the at-home application of highlighting solution to the hair which will allow the user control over the particular strands of hair that will be highlighted, the number of strands of hair affected by the solution, the thickness of the highlights, the amount of dye dispensed, as well as an opportunity to save and re-use any potentially wasted coloring agent. There is a need for a device, which not only holds strands of hair but also simultaneously applies dye, bleach, or color, and keeps the coloring agent(s) away from the scalp and from the rest of the hair.

SUMMARY OF THE INVENTION

It is an object of the present invention to provide a simple effective device for use in treating hair to provide color contrast thereto, as in highlighting or tinting, which is simple to use by the consumer seeking to highlight the consumer's hair at home and is efficient for its intended purpose.

It is also an object of the present invention to provide a simple yet structurally unique device that may both clamp and hold hair of various lengths and thickness and simultaneously apply a coloring agent with precision.

Another object of this invention is to provide a tong-like device that may secure sections of hairs of varying thickness at the end of the bottom prong and may apply coloring agent with any of sized detachable brush at the end of the top prong to allow for increasing or decreasing the amounts of highlights.

A further object of this invention is to provide an optional highlighting solution pump that will allow for adequate and controlled amounts of coloring agent to be distributed throughout the section of hair being held by the device by preferably attaching it to the top of the removable bristles.

In accordance with this invention, the hair highlighting device comprises an efficient and precise one-piece tong-like apparatus for a person to apply bleach or dye to selected strands of hair while maintaining control over the number of strands selected, the thickness of the highlights, the amount of dye used, and the consistency and even spreading of color throughout the selected strands.

An embodiment of the present invention is to provide a self-treating hair-coloring device suitable for use in highlighting selected strands of hair comprising: a tong-like flexible handle having two opposite ends, a first end and a second end; a detachable brush having a plurality of bristle rows attached to the first end by self-securing means for receiving a color treating agent; and a removable hair securer attached to the second end for receiving selected strands of hair to be treated for highlighting; and wherein the hair securer has a predetermined width for receiving the selected strands of hair to be treated. It is preferred that the self-treating hair-coloring device have a pump device attached to the detachable brush to continuously supply the color-treating agent to the selected strands of hair and that the tong-like handle be made of plastic tubing.

Another alternative embodiment of the present invention is to provide a hair highlighting device suitable for treating selected strands of hair comprising: a first resilient material having a first end; a second resilient material having a second end; a spring fastening device affixing said first resilient material to said second material so that the first end contacts the second; a detachable brush having a defined width and length secured to the first end to receive a color-treating agent; and a detachable hair securer having a defined width and length for receiving selected strands of hair.

Yet another preferred embodiment of the present invention is to provide a method of coloring selected groups of hair strands which comprises the steps of: applying a quantity of hair coloring agent to a brush having a plurality of bristles removably attached to one end of a tong-like device; selecting strands of hair to be highlighted; placing the strands of hair from a scalp of a user into a hair securer located at the end opposite the brush of the tong-like device; squeezing the tong-like device with one hand so that the two ends contact; and pulling the tong-like device from the scalp to the end of the length of selected strands so that the color treating agent is continuously applied during the pulling of the tong-like device.

Various other objects, advantages and features of the present invention will become apparent from the ensuing detailed description.

BRIEF DESCRIPTION OF THE DRAWINGS

The following detailed description, given by way of example, and not intended to limit the present invention solely thereto, will best be understood in conjunction with the accompanying drawings in which.

DETAILED DESCRIPTION OF PREFERRED EMBODIMENTS

The present invention is embodied in a unique apparatus for highlighting the hair. The device may be made of metal, plastic, or any other flexible, durable material.

Figure 1:
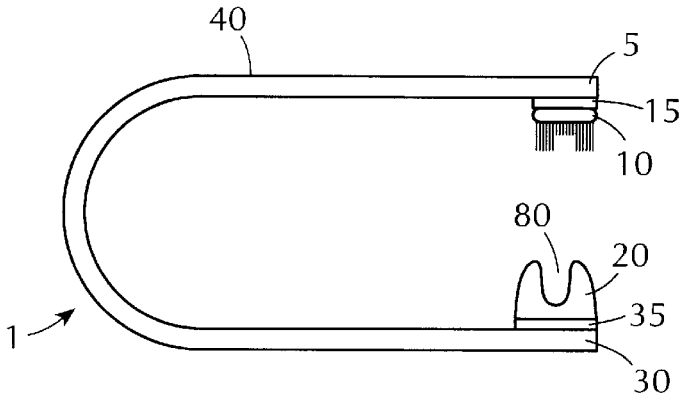
FIG. 1 is a side view of the present invention for self-highlighting.

As shown in FIG. 1, the tong-like handle 40 of the present invention 1 may be made of one continuous tubing or sheet of material. The tong-like handle 40 of the present invention has two opposite ends, 5, 30 and is shown folded back on itself approximately 180°. At the first end 5 of the tong-like handle 40 of the present invention 1 is located a detachable brush 10 that may consist of a plurality of rows of bristles. Preferably, as shown in FIG. 1, the inner rows of bristles are shorter than the outer rows of bristles. The brush 10 accepts any dyes or coloring agent for application to selected hair strands of the consumer. The brush 10 is attached to the handle 40 by a fastener 15, such as Velcro straps, snaps, clips and the like. At the second end 30 of the tong-like handle 40 of the present invention 1 is a removable hair securer 20 secured by a fastener 35, such as Velcro straps, clips, snaps and the like.

Figure 3A:
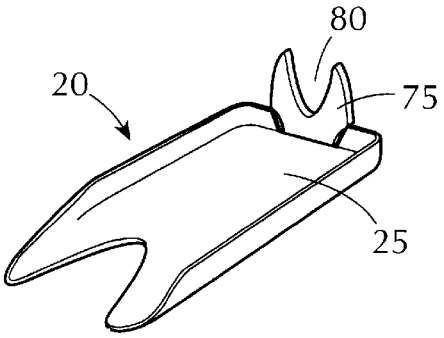
FIGS. 3A–3B arc elevational views of the hair securer of the present invention which is meant to secure strands of hair.
Figure 3B:
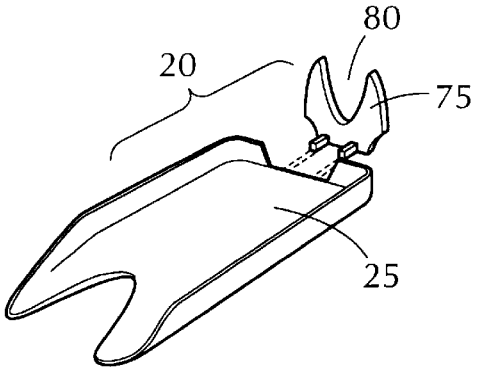

As illustrated in FIG. 1, the second end 30 of the bottom half of the tong-like handle 40 is where the hair will lie as is it held in the hair securer 20. The hair securer 20 has an indenting gap 80 in its center to help grip the selected hair strands and to help capture excess highlighting solution. In operation, the hair securer 20 is attached to the surface 30 by the fastener 35. The fastener 35 will allow for the hair securer 20 to be removed and replaced with a plurality of securers shown in FIGS. 4A–4C. Alternatively, as shown in FIGS. 3A and 3B, the hair securer 20 may include a base 25 that is slightly concave to help capture excess highlighting solution and a guide 75 having an indenting gap 80 in its center. In such alternative configuration, as shown in FIG. 3B, the guide 75 may be removed from the base 25 and replaced with a plurality of guides, each having a different sized indenting gap 80.

Figure 4A:
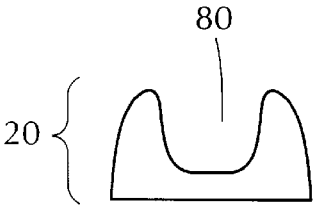
FIGS. 4A–4C are a side view of the various potentially interchangeable sizes of the part of the present invention meant to secure strands of hair.
Figure 4B:
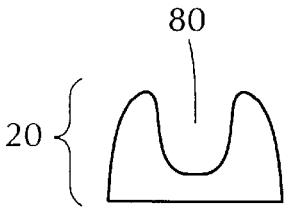
Figure 4C:
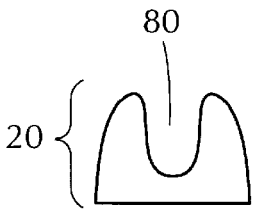

FIGS. 4A–4C show that the hair securer 20 may come in several embodiments, each differing in the size of the space which will hold and secure the strands of hair selected for highlighting by dye or color treating agent which sits on brush 10. As FIGS. 4A–4C show, the hair securer 20 will come in several sizes depending on the amount of hair a person wishes to dye in a given stroke.

Figure 5A:
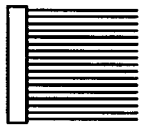
FIGS. 5A–5C are side views of the various sizes of the applicator brush of the present invention.
Figure 5B:
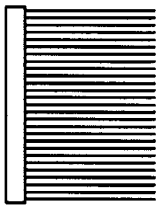
Figure 5C:
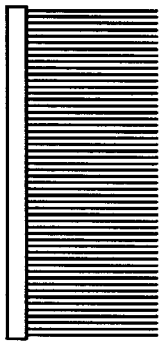

In the preferred form, the brush 10 is one of three bristle configurations from which a person may choose to attach to the tong of the present invention 1. FIGS. 5A–5C shows the three bristles of differing length, any of which may be attached to the device from the fastener 15, depending on the amount of dye or coloring agent a person wishes to use. The more hair that is held in the hair securer 20, the longer the bristle in order that more dye be held by the brush and applied to the selected strands of hair without a person having to re-dip the brush in the dye.

Figure 2:
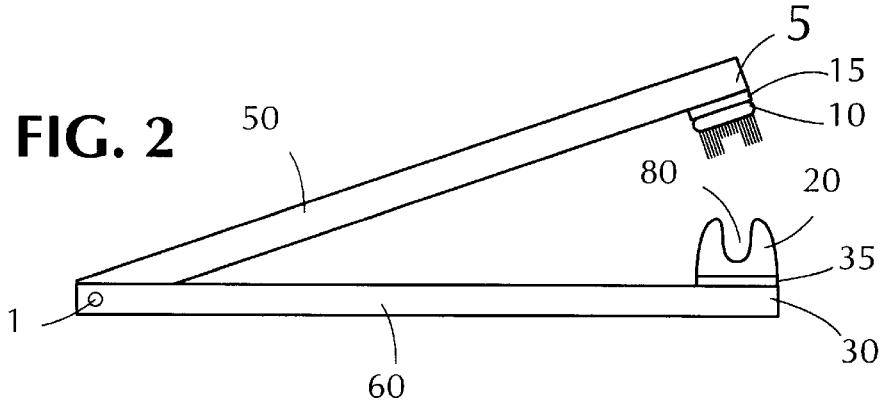
FIG. 2 is a side view of a different embodiment of the present invention for home highlighting.

In yet another embodiment, the handle of the present invention may be made of two pieces 50, 60, with the same two ends 5, 30 as shown in FIG. 1. The two pieces 50, 60 having preferably equal lengths are pivotally attached by and are able to move closer to and farther from each other by a fastener 70, such as a spring and the like. FIG. 1 and FIG. 2 are otherwise identical.

Figure 6:
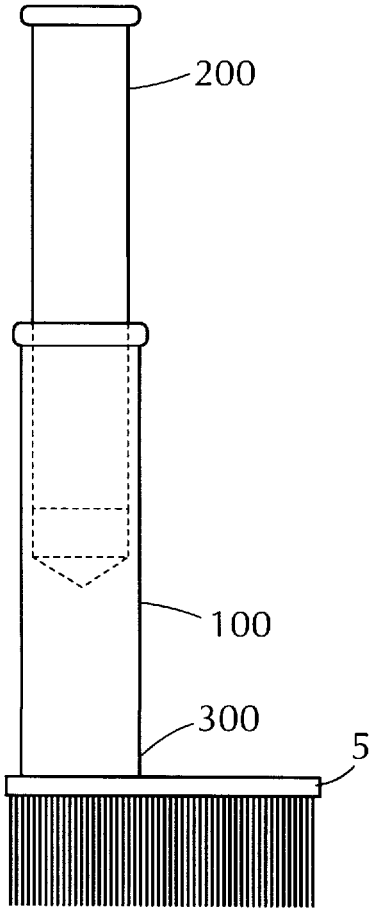
FIG. 6 is a side view of the attachable optional pump of the present invention.
Figure 7:
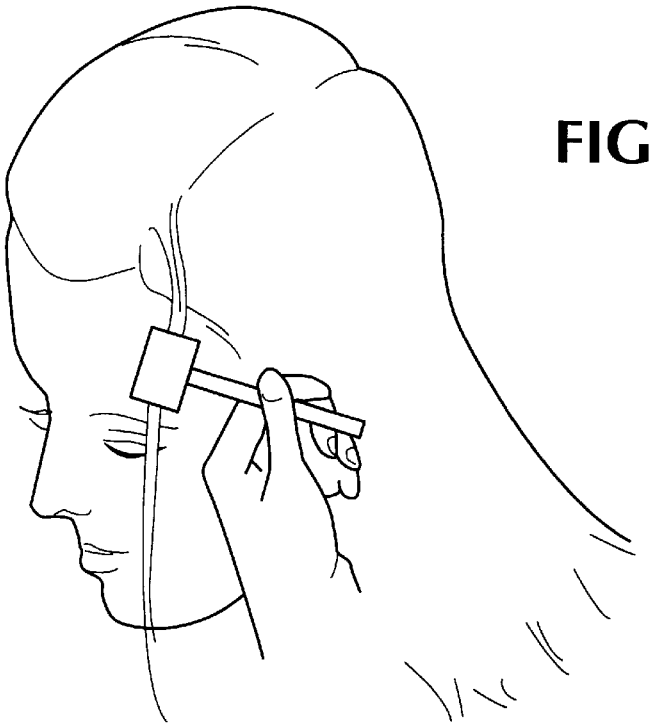
FIGS. 7 and 8 are photographic depictions of how the device of the present invention is to be used.
Figure 8:
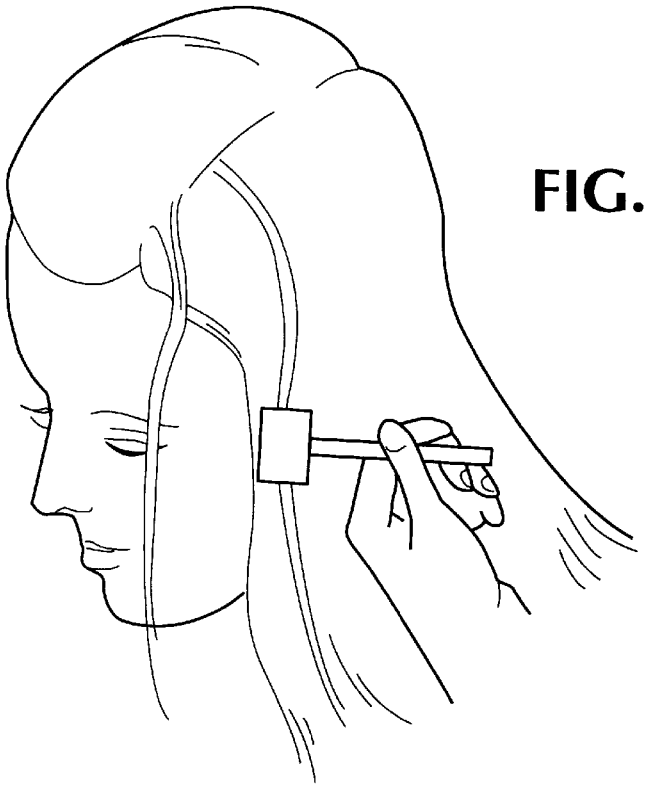
Figure 9A:
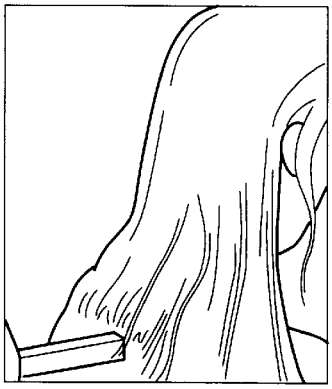
FIG. 9A PRIOR ART
FIGS. 9A–9F are photographic depictions of the prior art highlighting process as used in a professional hair salon.
Figure 9D:
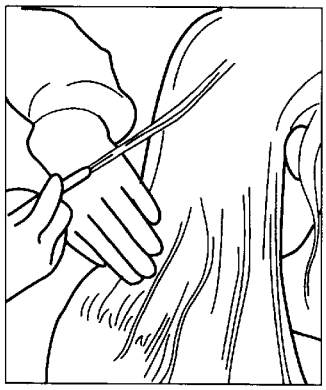
FIG. 9D PRIOR ART
Figure 9B:
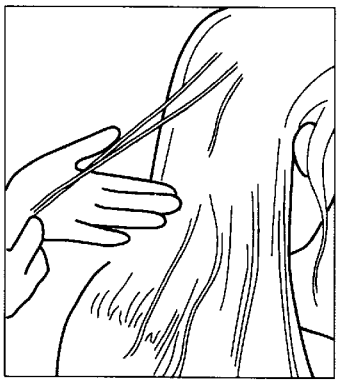
FIG. 9B PRIOR ART
Figure 9E:
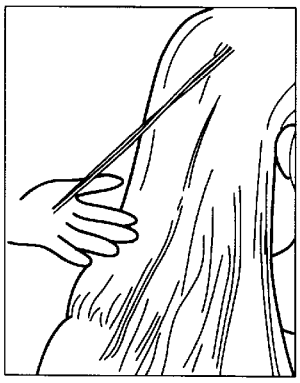
FIG. 9E PRIOR ART
Figure 9C:
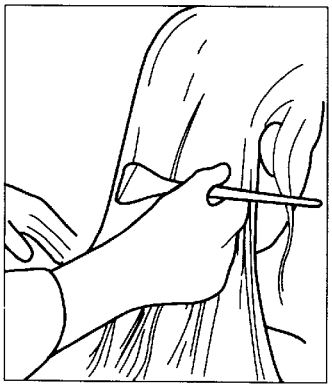
FIG. 9C PRIOR ART
Figure 9F:
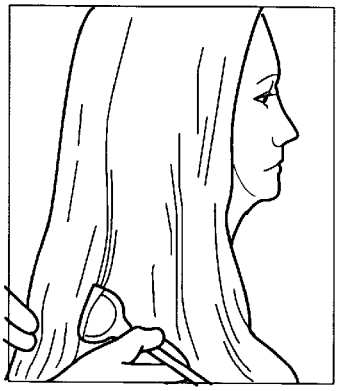
FIG. 9F PRIOR ART

FIG. 6 shows an optional pump for dispensing any dye or coloring agent into the bristles attachable to the one-piece handle 40 or the upper tong of the two-piece handle 50 by a fastener 15. The pump may consist of two parts. A first part 100 holds or contains the highlighting solution, and the second part 200 pushes the highlighting solution through holding section 100 with a syringe-like action onto the brush 10 through a tube 300. This process may facilitate highlighting longer strands of hair or numerous strands of hair without having to re-dip the bristle into any coloring agent or having to reapply any coloring agent to the bristle.

While the present invention has been particularly described with respect to the illustrated embodiment, it will be appreciated that various alterations, modifications and adaptations may be made based on the present disclosure, and are intended to be within the scope of the present invention. It is intended that the appended claims be interpreted as including the embodiment discussed above, those various alternatives, which have been described and all equivalents thereto.

What is claimed is:

1. A hair-coloring tool suitable for use in applying hair treatment preparations comprising at least hair coloring and highlighting products to selected strands of hair, the hair-coloring tool comprising:

a tong-like flexible handle having a first handle portion, a second handle portion and a connecting member, the first and second handle portions each having a proximal end, a distal end and a region for gripping between the proximal and distal ends, the connecting member movably connecting the proximal ends of the first and second handle portions so that the distal ends of the first and second handle portions can be moved with respect to one another;

a brush having a plurality of bristle rows attached to the distal end of the first handle portion, the plurality of bristle rows extending in at least two orthogonal directions, a first direction and a second direction, the plurality of bristle rows having a proximal end and a distal end in the first direction of extent, the brush for receiving a hair treatment preparation; and a hair guide attached to the distal end of the second handle portion, the hair guide comprising a base portion extending, in part, in the first direction and a grooved guide member extending outward from the base portion, the grooved guide member having an open-ended groove facing generally in the direction of the distal end of the first handle portion, wherein when the first and second handle portions are squeezed together during operation, the grooved guide member overlaps the proximal end of the plurality of bristle rows in the first direction of extent, wherein the overlapping grooved guide member and plurality of bristle rows form an enclosed guide for separating the selected strands of hair from those not being treated, for retaining the selected strands of hair during the treatment procedure, and for guiding the selected strands of hair over the bristles of the brush during the treatment procedure.

2. The hair-coloring tool of claim 1, further comprising: a pump device for supplying the hair treatment preparation to the selected strands of hair.

3. The hair-coloring tool of claim 1, wherein the tong-like handle is made of plastic tubing.

4. The hair-coloring tool of claim 1, wherein the brush is removably attached to the distal end of the first handle portion.

5. The hair-coloring tool of claim 4 further comprising a plurality of replaceable brushes of different dimensions, wherein the brushes can be interchanged between, or during, hair treatment sessions to achieve differing hair treatment effects.

6. The hair-coloring tool of claim 1 wherein the hair guide is removably attached to the second handle portion.

7. The hair-coloring tool of claim 6 further comprising a plurality of replaceable hair guides having hair guide portions comprised of hair guide members spaced different distances apart, thereby forming grooves of different widths, whereby the different replaceable hair guides can be interchanged to treat different volumes of hair.

8. The hair-coloring tool of claim 1 wherein the brush is integrally formed as part of the first handle portion.

9. The hair-coloring tool of claim 1 wherein the hair guide is integrally formed as part of the second handle portion.

10. The hair-coloring tool of claim 1 wherein the base portion has a concave shape opening in the direction of the distal end of the first handle portion and extending in the first direction.

11. The hair-coloring tool of claim 10 wherein the base portion has a proximal end and a distal end, wherein the hair guide portion extends outward from the base portion near the proximal end of the base portion, and wherein the base portion further comprises a distal end concave groove, the distal end concave groove opening in the first direction substantially orthogonal to the opening of the grooved guide member.

12. The hair-coloring tool of claim 10 wherein the brush comprises at least three rows of bristles extending in the first direction wherein the at least two outside rows of bristles are comprised of bristles longer than the at least one middle row, and wherein the difference in length between the at least two outside rows and at least one middle row forms a channel extending in the first direction for accepting the hair treatment preparation during a preparation step and for receiving strands of hair during a treatment step.

13. The hair-coloring tool of claim 12 wherein the base portion has a proximal end and a distal end, wherein the hair guide portion extends outward from the base portion near the proximal end of the base portion, and wherein the base portion further comprises a distal end concave groove, the distal end concave groove opening in the first direction substantially orthogonal to the opening of the grooved guide member.

14. The hair-coloring tool of claim 1 wherein the brush comprises at least three rows of bristles extending in the first direction wherein the at least two outside rows of bristles are comprised of bristles longer than the at least one middle row, and wherein the difference in length between the at least two outside rows and at least one middle row forms a channel extending in the first direction for accepting the hair treatment preparation during a preparation step and for receiving strands of hair during a treatment step.

15. The hair-coloring tool of claim 14 wherein the channel aligns with the groove formed by the hair guide portion when the first and second handle portions are squeezed together so that the hair guide portion overlaps the proximal end of the brush.

16. The hair-coloring tool of claim 14 wherein the base portion has a proximal end and a distal end, wherein the hair guide portion extends outward from the base portion near the proximal end of the base portion, and wherein the base portion further comprises a distal end concave groove, the distal end concave groove opening in the first direction substantially orthogonal to the opening of the grooved guide member.

17. The hair-coloring tool of claim 1 wherein the base portion has a proximal end and a distal end, wherein the hair guide portion extends outward from the base portion near the proximal end of the base portion, and wherein the base portion further comprises a distal end concave groove, the distal end concave groove opening in the first direction substantially orthogonal to the opening of the grooved guide member.

18. The hair-coloring tool of claim 1 wherein the connecting member comprises a spring fastener.

19. The hair-coloring tool of claim 1 wherein the connecting member comprises a rivet permitting rotational movement of the first and second handle portions.

20. The hair-coloring tool of claim 1 wherein the first and second handle portions and the connecting member are integrally formed at least in part from a resilient material that allows the first and second handle portions to be squeezed together.

21. A hair treatment tool suitable for treating selected strands of hair, comprising:

a first handle portion having a proximal end, a distal end and a region between the proximal and distal ends for gripping, the first handle portion made at least in part from a resilient material;

a second handle portion having a proximal end, a distal end and a region between the proximal and distal ends for gripping, the first handle portion made at least in part from a resilient material;

a spring fastener movably connecting the first and second handle portions;

a brush attached to the distal end of the first handle portion, the brush comprised of a plurality of bristle rows extending in at least two orthogonal directions, a first direction and a second direction, the plurality of bristle rows terminating at a proximal end and a distal end in the first direction of extent;

a hair guide comprising a base portion generally aligning with the brush when the first and second handle are squeezed together, the hair guide further comprising a hair guide portion formed by two hair guide members extending outward from the base portion generally in the direction of the distal end of the first handle portion, the two hair guide members and base portion forming an open-ended groove, the open end of the groove facing generally in the direction of the distal end of the first handle portion, the hair guide portion overlapping the proximal end of the brush when the first and second handle portions are squeezed; and wherein the overlapping hair guide portion and plurality of bristle rows form an enclosed guide for separating the selected strands of hair from those not being treated, for retaining the selected strands of hair during the treatment procedure, and for guiding the selected strands of hair over the bristles of the brush during the treatment procedure.

22. The hair treatment tool of claim 21 further comprising a plurality of replaceable brushes of different dimensions, wherein the brushes can be interchanged between, or during, hair treatment sessions to achieve differing hair treatment effects.

23. The hair treatment tool of claim 21 wherein the hair guide is removably attached to the second handle portion.

24. The hair treatment tool of claim 23 further comprising a plurality of replaceable hair guides having hair guide portions comprised of hair guide members spaced different distances apart thereby forming grooves of different widths, whereby the different replaceable hair guides can be interchanged to treat different volumes of hair.

25. The hair treatment tool of claim 21 wherein the brush is integrally formed as part of the first handle portion.

26. The hair treatment tool of claim 21 wherein the hair guide is integrally formed as part of the second handle portion.

27. The hair coloring tool of claim 21 wherein the base portion has a concave-shaped opening in the direction of the distal end of the first handle portion and extending substantially in the first direction.

28. The hair treatment tool of claim 27 wherein the base portion has a proximal end and a distal end, wherein the hair guide portion extends outward from the base portion near the proximal end of the base portion, and wherein the base portion further comprises a distal end concave groove, the distal end concave groove opening in a direction substantially orthogonal to the opening of the hair guide portion.

29. The hair treatment tool of claim 27 wherein the brush comprises at least three rows of bristles extending in the first direction wherein the at least two outside rows of bristles are comprised of bristles longer than the at least one middle row, and wherein the difference in length between the at least two outside rows and at least one middle row forms a channel extending in the first direction for accepting the hair treatment preparation during a preparation step and for receiving strands of hair during a treatment step.

30. The hair treatment tool of claim 29 wherein the base portion has a proximal end and a distal end, wherein the hair guide portion extends outward from the base portion near the proximal end of the base portion, and wherein the base portion further comprises a distal end concave groove, the distal end concave groove opening in a direction substantially orthogonal to the opening of the hair guide portion.

31. The hair treatment tool of claim 21 wherein the brush comprises at least three rows of bristles extending in the first direction wherein the at least two outside rows of bristles are comprised of bristles longer than the at least one middle row, and wherein the difference in length between the at least two outside rows and at least one middle row forms a channel extending in the first direction for accepting the hair treatment preparation during a preparation step and for receiving strands of hair during a treatment step.

32. The hair-coloring tool of claim 31 wherein the channel aligns with the groove formed by the hair guide portion when the first and second handle portions are squeezed together so that the hair guide portion overlaps the proximal end of the brush.

33. The hair treatment tool of claim 31 wherein the base portion has a proximal end and a distal end, wherein the hair guide portion extends outward from the base portion near the proximal end of the base portion, and wherein the base portion further comprises a distal end concave groove, the distal end concave groove opening in a direction substantially orthogonal to the opening of the hair guide portion.

34. The hair treatment tool of claim 21 wherein the base portion has a proximal end and a distal end, wherein the hair guide portion extends outward from the base portion near the proximal end of the base portion, and wherein the base portion further comprises a distal end concave groove, the distal end concave groove opening in a direction substantially orthogonal to the opening of the hair guide portion.

35. A hair coloring tool for applying fluid material to selected strands of hair, comprising:

a fluid applying device for retaining and bringing a treatment fluid into contact with the strands of hair, the fluid applying device having a proximal and a distal end;

a hair securing device comprising a base portion, the hair securing device further comprising a groove guide extending outward from the base portion, the groove guide for capturing and guiding selected strands of hair to be treated; and a support handle for supporting said fluid applying device and said securing device in movable relationship to each other between a proximal relationship wherein said groove guide overlays the proximal end of the fluid applying device and wherein said fluid applying device can bring the treatment fluid into contact with the strands of hair, and a distal relationship in which selected strands of hair can be manually placed in said groove guide of said hair securing device.

36. The hair coloring tool of claim 35, wherein the support handle comprises a tong-like handle made of a flexible, durable material.

37. The hair coloring device of claim 36, wherein said hair securing device comprises a base for capturing excess treatment fluid.

38. The hair coloring tool of claim 35, wherein the fluid applying device comprises a brush having a plurality of bristle rows.

39. A method of coloring selected groups of hair strands using a ton-like handle having a first handle portion a second handle portion and a connecting member movably connecting the first and second handle portions, the first and second handle portions having a proximal end, a distal end and a region for gripping between the proximal and distal ends, the method comprising the steps of:

applying a quantity of hair coloring agent to a brush having a plurality of rows of bristles attached to the distal end of the first handle portion of the tong-like handle, the rows of bristles extending in at least two directions, a first direction and a second direction, the rows of bristles having a proximal end and a distal end in the first direction of extent;

selecting strands of hair to be treated;

placing the selected hair strands into a grooved hair guide member of a hair guide located at the distal end of the second handle portion;

squeezing the tong-like handle with one hand so that the distal ends of the first and second handle portions move to a position wherein the grooved guide member overlaps the proximal end of the brush, wherein the overlapping grooved hair guide member and the brush forming an opening enclosed substantially on all sides that separates the selected strands of hair from those not being treated, and retains the selected hair strands during the treatment procedure; and pulling the tong-like instrument along the lengthwise direction of the selected strands while squeezing the tong-like handle so that the grooved guide member guides the selected hair strands over the bristles of the brush whereby color treating agent is applied to the selected hair strands as the tong-like handle is pulled along the selected hair strands.

40. The method of claim 39 further comprising:

easing the grip on the tong-like handle so that the first and second handle portions move apart from one another;

removing the treated hair from the grooved hair guide;

applying an additional quantity of hair coloring agent to the brush;

selecting a new group of hair strands for treatment;

placing the newly-selected strands of hair into the grooved hair guide;

squeezing the tong-like handle so that the grooved guide member overlaps the proximal end of the brush and the selected hair strands come into contact with the brush; and pulling the tong-like handle along the lengthwise direction of the newly-selected strand of hair to apply the hair coloring agent to the newly-selected strands of hair.

41. The method of claim 40 further comprising repeating the steps of claim 40 until the desired hair coloring effect is achieved.

42. A hair-coloring tool for use in applying hair treatment preparations to hair, wherein during hair treatment a person performing the treatment grasps a group of adjacent hair strands and uses the hair coloring tool to apply the hair treatment preparation to the hair strands in a sliding motion in a treatment direction coinciding with the lengthwise extent of the group of adjacent hair strands, the hair-coloring tool comprising:

a tong-like flexible handle having a first handle portion, a second handle portion and a connecting member, wherein the first handle portion and second handle portion each have a proximal end, a distal end, and a region for gripping intermediate between the proximal and distal ends, wherein the connecting member movably connects the proximal ends of the first and second handle portions and wherein the first and second handle portions extend in a direction approximately perpendicular to the treatment direction when in use;

a brush mounted to the distal end of the of the first handle portion of the tong-like flexible handle, wherein the brush comprises a bristle holder mounted to the first handle portion, the bristle holder having a plurality of holes organized in a regular grid of rows extending in at least two orthogonal directions, a first direction and a second direction, and wherein a plurality of bristles is fixedly mounted in each bristle hole, the individual bristles extending in a direction toward the distal end of the second handle portion, the individual bristles having bristle ends that collectively form a surface for accepting hair treatment preparations, and wherein in the first direction of extent the plurality of bristles collectively terminate at a proximal and a distal end, the first direction of extent generally coinciding with the treatment direction, a hair guide for operating in conjunction with the brush when the tong-like handle is squeezed, the hair guide comprising a base portion extending, in part, in the hair treatment direction, the base portion having a proximal end and distal end in the hair treatment direction, the hair guide further comprising a hair guide portion extending outward from the base portion near the proximal end of the base portion, the hair guide portion comprising two hair guide members extending in a direction toward the distal end of the first handle portion, the hair guide members and base portion together forming an open-ended U-shape wherein the open end of the U-shape faces in the direction of the distal end of the first handle portion; and wherein when the tong-like flexible handle is loosely held in an open, accessible position, hair treatment preparations may be applied to the brush and the selected group of hair strands may be placed in the U-shaped hair guide portion, and wherein when the tong-like handle is squeezed, the base portion and brush together sandwich a portion of the group of hair strands, and the hair guide portion overlaps the proximal end of the brush, forming an enclosed guide for guiding the group of adjacent hair strands to be treated over the bristles of the brush.

43. The hair-coloring tool of claim 42 wherein the connecting member comprises a spring fastener.

44. The hair-coloring tool of claim 42 wherein the connecting member comprises a rivet permitting rotational movement of the first and second handle portions.

45. The hair-coloring tool of claim 42 wherein the first and second handle portions and the connecting member are integrally formed at least in part from a resilient material that allows the first and second handle portions to be squeezed together.

46. The hair-coloring tool of claim 42, further comprising:

a pump device for supplying the hair treatment preparation to the selected strands of hair.

47. The hair-coloring tool of claim 42 wherein an intermediate recessed channel is formed in the surface defined by the bristle ends, the recessed channel extending in the treatment direction, wherein at the proximal and distal ends of the brush in the treatment direction, the brush has outer bristles surrounding inner bristles, wherein the inner bristles are shorter than the surrounding outer bristles.

48. The hair-coloring tool of claim 47 wherein the base portion further comprises a distal end concave groove, the distal end concave groove opening in the treatment direction substantially orthogonal to the U-shaped opening of the hair guide portion.

49. The hair-coloring tool of claim 47 wherein the base portion of the hair guide has a concave shape opening in the direction of the surface formed by the bristle ends and extending substantially in the treatment direction.

50. The hair-coloring tool of claim 49 wherein the base portion further comprises a distal end concave groove, the distal end concave groove opening in the treatment direction substantially orthogonal to the U-shaped opening of the hair guide portion.

51. The hair-coloring tool of claim 42 wherein the base portion of the hair guide has a concave shape opening in the direction of the surface formed by the bristle ends and extending laterally in the treatment direction.

52. The hair-coloring tool of claim 51 wherein the base portion further comprises a distal end concave groove, the distal end concave groove opening in the treatment direction substantially orthogonal to the U-shaped opening of the hair guide portion.

53. The hair-coloring tool of claim 42 wherein the base portion further comprises a distal end concave groove, the distal end concave groove opening in the treatment direction substantially orthogonal to the U-shaped opening of the hair guide portion.

54. A hair-coloring tool comprising:

a tong-like handle forming an open-ended U-shape, the tong-like handle having a first handle portion forming a first upright of the U-shape and a second handle portion forming a second upright of the U-shape, the first and second handle portions each having a proximal end, a distal end and a region for gripping between the proximal and distal ends, the tong-like handle further comprising a connecting member connecting the proximal ends of the first and second handle portions, the connecting member permitting relative movement of the first and second handle portions so that the distal ends of the first and second handle portions may contact one another;

a brush mounted to the distal end of the first handle portion, the brush comprising a bristle holder having at least three substantially parallel rows of bristles, wherein the at least three rows of bristles extend in a first direction substantially perpendicular to the direction of the first handle portion and the individual bristles themselves extend in a direction toward the distal end of the second handle portion, the bristles having bristle ends forming a surface for accepting hair treatment preparations, the at least three substantially parallel rows of bristles having a proximal end and a distal end in the first direction;

a hair guide mounted to the distal end of the second handle portion, the hair guide extending, in part, in substantially the same direction as the three parallel rows of bristles and generally perpendicular to the second handle portion, the hair guide comprising a base portion defining a surface facing generally toward the distal end of the first handle portion, the base portion having a proximal end and a distal end in the first direction, the hair guide further comprising a hair guide portion extending outward from the base portion near the proximal end of the base portion, the hair guide portion comprising two hair guide members that in combination with the base portion form an open-ended U-shape, wherein the open end of the U-shape of the hair guide portion faces in the direction of the distal end of the first handle portion; and wherein when the handle portions are squeezed bringing the distal ends of the first and second handle portions in close proximity, the hair guide portion overlaps the proximal end of the at least three parallel rows of bristles and in combination with the bristle ends forms an enclosed guide for retaining hair strands selected for treatment and for guiding the selected hair strands over the bristle ends during the treatment procedure.

55. The hair-coloring tool of claim 54 wherein the connecting member comprises a spring fastener.

56. The hair-coloring tool of claim 54 wherein the connecting member comprises a rivet permitting rotational movement of the first and second handle portions.

57. The hair-coloring tool of claim 54 wherein the first and second handle portions and the connecting member are integrally formed at least in part from a resilient material that allows the first and second handle portions to be squeezed together.

58. The hair coloring tool of claim 54 further comprising:

a pump device attached to the hair-coloring tool for supplying hair treatment to the bristles of the brush during hair treatment.

59. The hair coloring tool of claim 54 wherein the surface defined by the base portion is substantially flat.

60. The hair coloring tool of claim 54 wherein the surface defined by the base portion is concave-shaped opening in a direction toward the distal end of the first handle portion.

61. The hair-coloring tool of claim 60 wherein the base portion further comprises a distal end concave groove, the distal end concave groove opening in the first direction substantially orthogonal to the U-shaped opening of the hair guide portion.

62. The hair coloring tool of claim 60 wherein the lengths of the bristles of the outer at least two bristle rows are longer than the bristles of the inner one or more bristle rows, wherein the difference in height forms a channel extending generally in the direction perpendicular to the first handle portion for accepting a hair treatment preparation.

63. The hair-coloring tool of claim 62 wherein the base portion further comprises a distal end concave groove, the distal end concave groove opening in the first direction substantially orthogonal to the U-shaped opening of the hair guide portion.

64. The hair coloring tool of claim 54 wherein the lengths of the bristles of the outer at least two bristle rows are longer than the bristles of the inner one or more bristle rows, wherein the difference in height forms a channel extending generally in the direction perpendicular to the first handle portion, the channel for accepting a hair treatment preparation.

65. The hair-coloring tool of claim 64 wherein the base portion further comprises a distal end concave groove, the distal end concave groove opening in the first direction substantially orthogonal to the U-shaped opening of the hair guide portion.

66. The hair coloring tool of claim 54 wherein there are at least three pairs of bristle rows extending in the direction generally perpendicular to the direction of the first handle portion, wherein the lengths of the bristles of the outer two pair of bristle rows are longer than the bristles of the inside pair of bristle rows, wherein the difference in height forms a channel extending generally in the direction perpendicular to the first handle portion for accepting a hair treatment preparation.

67. The hair-coloring tool of claim 54 wherein the base portion further comprises a distal end concave groove, the distal end concave groove opening in the first direction substantially orthogonal to the U-shaped opening of the hair guide portion.

68. A hair-coloring tool for treating selected hair strands comprising:

a tong-like handle generally forming an open-ended U-shape, the tong-like handle having a first handle portion forming a first upright of the U-shape and a second handle portion forming a second upright of the U-shape, the first and second handle portions each having a proximal end, a distal end and a region for gripping between the proximal and distal ends, the tong-like handle further comprising a connecting member connecting the proximal ends of the first and second handle portions, the connecting member permitting relative movement of the first and second handle portions so that the distal ends of the first and second handle portions may contact one another;

a brush mounted to the distal end of the first handle portion, the brush comprising a bristle holder fixedly retaining a plurality of bristles, wherein the plurality of bristles extend in two orthogonal directions, a first direction and a second direction, the plurality of bristles having a proximal end and a distal end in the first direction, the individual bristles having bristle ends that together form a surface for receiving hair treatment preparations comprising at least hair coloring agents, the individual bristles extending in a third direction generally toward the distal end of the second handle portion;

a hair guide mounted to the distal end of the second handle portion, the hair guide comprising a base portion defining a surface facing generally toward the distal end of the first handle portion and extending, in part, in substantially the same direction as the first direction of the plurality of bristles, the base portion having a proximal end and a distal end in the first direction, the hair guide further comprising a hair guide portion extending outward from the base portion near the proximal end of the base portion, the hair guide portion comprising two hair guide members that in combination with the base portion form an open-ended U-shape, wherein the open end of the U-shape of the hair guide portion faces in the direction of the distal end of the first handle portion; and wherein when the handle portions are loosely held, the selected hair strands may be placed in the U-shaped hair guide portion, and wherein when the handle portions are squeezed bringing the distal ends of the first and second handle portions in close proximity, the hair guide portion overlaps the proximal end of the plurality of bristles thereby capturing and retaining the hair strands that have been selected for treatment by forming an enclosed guide in combination with the bristle ends.

69. The hair-coloring tool of claim 68 wherein the connecting member comprises a spring fastener.

70. The hair-coloring tool of claim 68 wherein the connecting member comprises a rivet permitting rotational movement of the first and second handle portions.

71. The hair-coloring tool of claim 68 wherein the first and second handle portions and the connecting member are integrally formed at least in part from a resilient material that allows the first and second handle portions to be squeezed together.

72. The hair-coloring tool of claim 68, further comprising:

a pump device for supplying the hair treatment preparation to the selected strands of hair.

73. The hair coloring tool of claim 68 wherein the surface defined by the base portion is flat.

74. The hair coloring tool of claim 68 wherein the surface defined by the base portion is concave-shaped opening toward the distal end of the first handle portion and extending in the first direction.

75. The hair coloring tool of claim 74 wherein the base portion further comprises a distal end concave groove, the distal end concave groove opening in the first direction substantially orthogonal to the U-shaped opening of the hair guide portion.

76. The hair coloring tool of claim 74 wherein an intermediate recessed channel is formed in the surface defined by the bristle ends, the recessed channel extending generally in the first direction, the recessed channel for receiving hair treatment preparations.

77. The hair coloring tool of claim 76 wherein the base portion further comprises a distal end concave groove, the distal end concave groove opening in the first direction substantially orthogonal to the U-shaped opening of the hair guide portion.

78. The hair coloring tool of claim 68 wherein an intermediate recessed channel is formed in the surface defined by the bristle ends, the recessed channel extending generally in the first direction, the recessed channel for receiving hair treatment preparations.

79. The hair coloring tool of claim 78 wherein the base portion further comprises a distal end concave groove, the distal end concave groove opening in the first direction substantially orthogonal to the U-shaped opening of the hair guide portion.

80. The hair coloring tool of claim 68 wherein the base portion further comprises a distal end concave groove, the distal end concave groove opening in the first direction substantially orthogonal to the U-shaped opening of the hair guide portion.

81. A hair-coloring tool for applying hair coloring agents to selected strands of hair comprising:

a brush comprising a bristle holder fixedly retaining a plurality of bristles extending in at least two orthogonal directions, a first direction and a second direction, the bristles having bristle ends that define a surface for accepting hair coloring agents, the plurality of bristles further having a proximal end and a distal end in the first direction;

a hair guide comprising a base portion and a hair guide portion, the base portion defining a surface at least the same dimension as the surface formed by the bristles ends, the hair guide portion comprising two hair guide members extending outward from the base portion, the hair guide members and base portion together forming a grooved guide having an open end, the open end of the grooved guide generally facing toward the surface defined by the bristles; and a handle comprising first and second handle portions movably connected by a connecting member, the first and second handle portions comprising at least a gripping region and a distal end, the distal end of the first handle portion attached to the bristle holder of the brush and the distal end of the second handle portion attached to the base portion of the hair guide, wherein when the first and second handle portions are squeezed together, the hair guide portion of the hair guide overlaps the proximal end of the bristles of the brush in the first direction, forming an enclosed guide for separating selected hair strands for treatment from hair not being treated, for retaining the selected hair strands during the treatment process, and for guiding the selected hair strands over the bristle ends, and wherein at least a portion of the selected hair strands are sandwiched between the bristle ends and the base portion of the hair guide.

82. The hair-coloring tool of claim 81 wherein an intermediate recessed channel is formed in the surface defined by the bristle ends, the recessed channel extending in the first direction, wherein at the proximal and distal ends of the brush in the first direction, the intermediate bristles are shorter than the surrounding outer bristles.

83. The hair-coloring tool of claim 82 wherein the base portion further comprises a proximal end and a distal end, the hair guide portion extending outward from the base portion near the proximal end of the base portion, the base portion having a distal end concave groove, the distal end concave groove opening in the first direction substantially orthogonal to the grooved guide of the hair guide portion.

84. The hair-coloring tool of claim 82 wherein the base portion of the hair guide has a concave shape opening in the direction of the surface defined by the bristle ends and extending substantially in the first direction.

85. The hair-coloring tool of claim 84 wherein the base portion further comprises a proximal end and a distal end, the hair guide portion extending outward from the base portion near the proximal end of the base portion, the base portion having a distal end concave groove, the distal end concave groove opening in the first direction substantially orthogonal to the grooved guide of the hair guide portion.

86. The hair-coloring tool of claim 81 wherein the base portion of the hair guide has a concave shape opening in the direction of the surface defined by the bristle ends and extending substantially in the first direction.

87. The hair-coloring tool of claim 86 wherein the base portion further comprises a proximal end and a distal end, the hair guide portion extending outward from the base portion near the proximal end of the base portion, the base portion having a distal end concave groove, the distal end concave groove opening in the first direction substantially orthogonal to the grooved guide of the hair guide portion.

88. The hair-coloring tool of claim 81 wherein the base portion further comprises a proximal end and a distal end, the hair guide portion extending outward from the base portion near the proximal end of the base portion, the base portion having a distal end concave groove, the distal end concave groove opening in the first direction substantially orthogonal to the grooved guide of the hair guide portion.

* * * * *